United States Patent [19]

Shimizu

[11] Patent Number: 5,059,805

[45] Date of Patent: Oct. 22, 1991

[54] MINERAL LIQUID PRODUCING DEVICE

[75] Inventor: Yasuhiro Shimizu, Isehara, Japan

[73] Assignee: Toshin Technical Co., Ltd., Kanagawa, Japan

[21] Appl. No.: 322,808

[22] Filed: Mar. 13, 1989

[30] Foreign Application Priority Data

Dec. 12, 1988 [JP] Japan ..... 63-313499

[51] Int. Cl.[5] ..... G21H 5/00

[52] U.S. Cl. ..... 250/436; 250/437; 250/438

[58] Field of Search ..... 250/493.1, 432 R, 435, 250/436, 437, 438

[56] References Cited

U.S. PATENT DOCUMENTS 907,066 12/1908 Loewenthal et al. ..... 250/432 PD
1,239,227 9/1917 Saubermann ..... 250/435
1,839,270 1/1932 Senftner ..... 250/493.1
1,859,904 5/1932 Wichmann ..... 250/493.1
1,991,934 2/1935 McCray ..... 250/436

FOREIGN PATENT DOCUMENTS 47-25358 10/1972 Japan .
48-97356 12/1973 Japan .

OTHER PUBLICATIONS

CRC Handbook of Chemistry and Physics, 59th Edition, 1978–1979, pp. B-418–B-427.
Faires and Parks, "Radioisotope Laboratory Techniques", 1973, pp. 12, 53–55, and 68.

*Primary Examiner*—Jack I. Berman
*Attorney, Agent, or Firm*—Guy W. Shoup; Norman R. Klivans

[57] ABSTRACT

A mineral liquid producing device in which a mineral liquid is produced by flowing and circulating a liquid against an activating stone which includes radium oxide, tantalum oxide and yttrium oxide for radiating Alpha-rays, Gamma-rays and Beta-rays.

5 Claims, 3 Drawing Sheets

MINERAL LIQUID PRODUCING DEVICE

BACKGROUND OF THE INVENTION

1. Field of the Invention

This invention relates to a mineral liquid producing device and more particularly to a mineral liquid producing device in which mineral liquid is produced by flowing and circulating a liquid for example water against an activating stone which includes radium oxide, tantalum oxide and yttrium oxide for radiating Alpha-rays, Gamma-rays and Beta-rays.

2. Related Art Statement

As to the conventionally employed mineral water producing devices, there have been proposed a variety of constructions, as typified by the construction such as disclosed in Japanese Patent publications KOKAI 48-97356 and 47-25358.

Said publications 48-97356 and 47-25358 disclose a construction in which a mineral stone is housed in a vessel, and water is housed in said vessel, and the water is taken from said vessel after a certain time has elapsed as mineral water.

In the above described mineral water producing device, the following problems were presented.

Namely, in said conventional construction, the ability to produce a mineral water is poor since said water is housed in a storage reservoir.

And also in a wine bar or restaurant, where bottled mineral water is employed, the need for many bottles is a problem.

SUMMARY OF THE INVENTION

In view of these drawbacks of the prior art, it is a principal object of the present invention to provide a mineral liquid producing device in which mineral liquid is produced by flowing and circulating a liquid against an activating stone which includes radium oxide, tantalum oxide and yttrium oxide for radiating Alpha-rays, Gamma-rays and Beta-rays.

The mineral liquid producing device according to the present invention comprises a housing member for housing an activating stone, a liquid circulating means for circulating a liquid for example water in said housing member, whereby said water is changed to a mineral liquid by circulating said water on said activating stone.

The mineral liquid producing device of the present invention is able to continuously and quickly produce a mineral liquid for family and business uses, whereby there is no necessity of bottled mineral water.

Mineral liquid produced by this invention has the activating elements which are derived from said activating stone and these activate cells of the human body in the case of mineral water.

EMBODIMENT OF THE INVENTION

A preferred embodiment of the mineral liquid producing device of the present invention will be hereafter explained by referring to the accompanying drawings.

Figure 1:
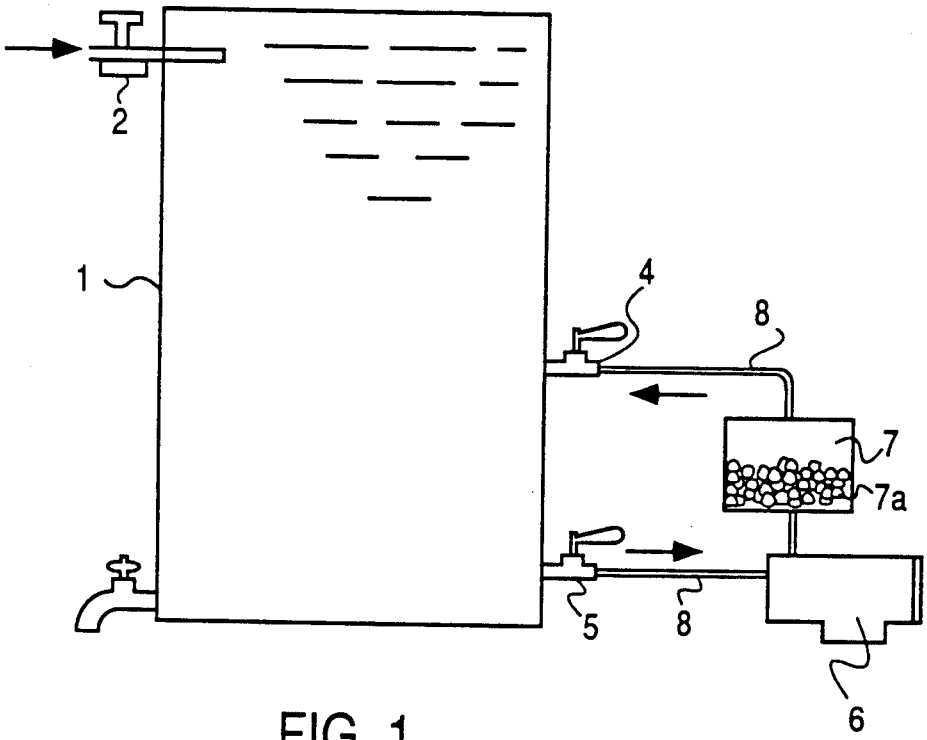
FIG. 1 shows a side sectional view for showing a mineral liquid producing device of the present invention.

In FIG. 1, a liquid supply pipe 2 for supplying a liquid for example water and a liquid outlet pipe for taking out water are mounted to a tank 1, a circulating pump 6 is connected to an inlet pipe 4 and outlet pipe 5 which are mounted to a wall of said tank 1, a housing member including activating stones 7*a* is disposed between said tank 1 and circulating pump 6, and said inlet pipe 4, outlet pipe 5, circulating pump 6 and housing member 7 are connected to each other so that a liquid is circulated therein.

In the above noted construction, when said circulating pump 6 is operated, a liquid in said tank 1 is taken from said outlet pipe 5 and passes through said housing member 7 and inlet pipe 4 and circulated therein.

When said circulation of water is performed, a liquid in said tank 1 is changed to a mineral liquid for example water in a very short time from about 15 minutes to one hour according to the amount of liquid.

For example, if a flow amount of said pump 6 is 20 l/minute, the pump motor is 100 V and 30 W, an ability for producing a mineral liquid is 120 l/hour.

Figure 2:
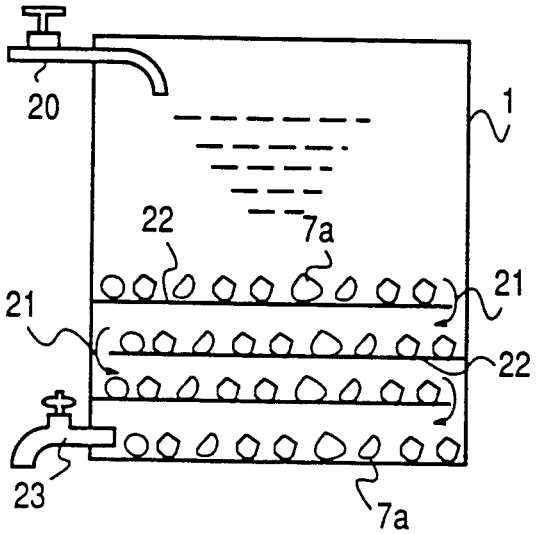
FIGS. 2, 3, and 4 show side sectional views for other embodiments of the present invention.
Figure 3:
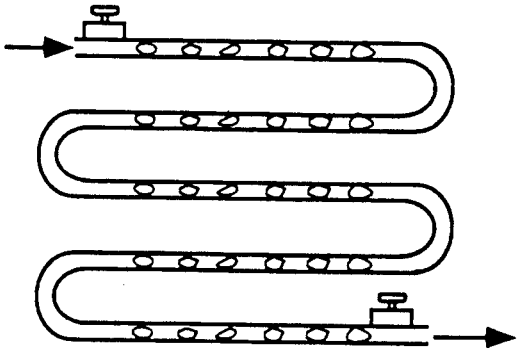

Further, in the construction of FIG. 2, a natural falling system is disclosed, an original liquid fed from a liquid supply portion 20 to a tank 1 passes through holes 21 of a separating plate 22 and said activating stones 7*a*, wherein a mineral liquid is obtained from an outlet port 23 of said tank 1.

Figure 4:
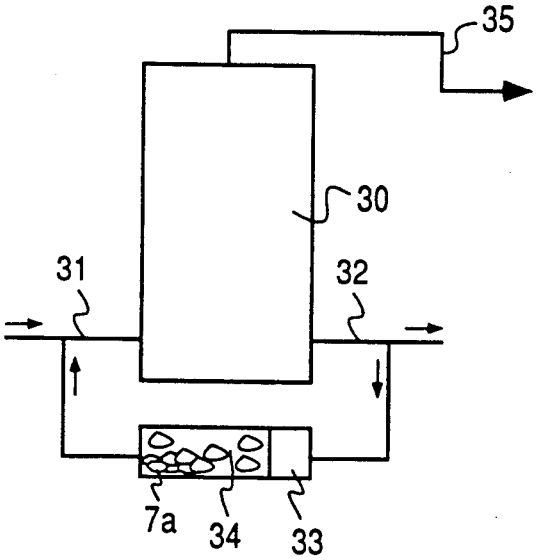

FIG. 4 shows a mineral liquid producing device using an electric water heater, having a housing member 34 including said activating stones 7*a* and having a circulating pump 33 mounted between a liquid supply pipe 31 of an electric liquid heater 30 and water outlet pipe 32, so that said liquid is always circulated to said activating stones 7*a*, whereby the liquid is changed to a mineral liquid.

Further, it is possible to obtain mineral liquid from an upper outlet port 35. Also, it is possible to produce a mineral liquid in a solar water heating system (not shown) according to the same structure as the above noted device.

Said activating stone 7*a* is composed of radium oxide 5.90%, thorium oxide 1.29%, niobium oxide 1.39%, tantalum oxide 3.83%, yttrium oxide 38.29%, calium oxide 0.43%, silicate oxide 1.64%, iron oxide 1.04%, alminum oxide 0.55%, titanium oxide 0.19%, manganese oxide 0.10%, and radiates Alpha-rays, Beta-rays, and Gamma-rays, and the radioactive half life thereof is about 1624 years.

Figure 5:
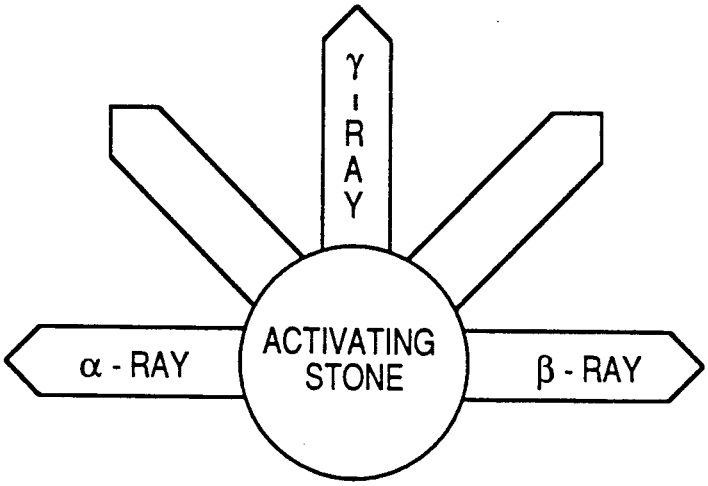
FIG. 5 shows an explanatory view for showing radiation of an activating stone of the present invention.

Therefore, the Alpha-rays have a cleaning action on water and the Gamma-rays have a pasteurization effect on water as shown in FIG. 5.

Figure 6:
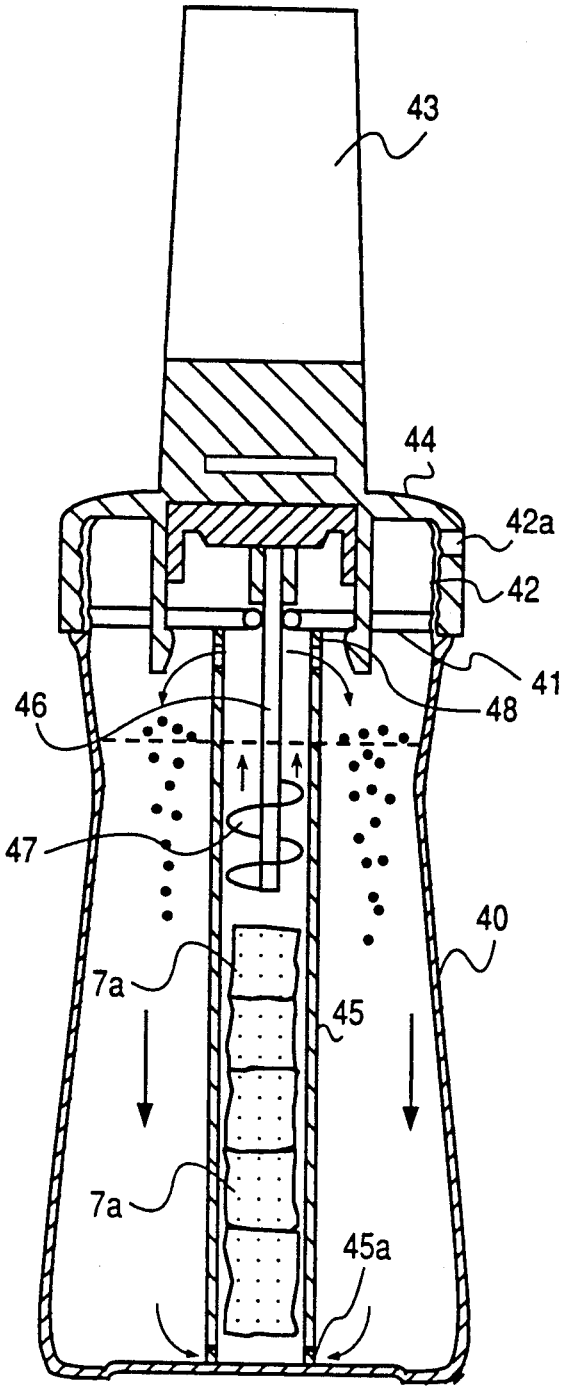
FIG. 6 shows a cross sectional view of another embodiment of the present invention.

Further, in FIG. 6, numeral 40 is a transparent vessel having an upper opening portion 41, a cover member 44 in which a motor driven by a battery is detachably mounted on a threaded portion 42 which is formed near a portion of said upper opening portion 41.

A plurality of air holes 42*a* are formed in a central position of said cover member 44, an inside of said vessel 1 and outside thereof are connected via said air holes 42*a*, and said air holes 42*a* are closed when said cover member 44 is closed, and said air holes 42*a* are opened when said cover member 44 is opened.

A water circulating cylinder 45 is mounted to said cover member 44, and a rotary screw member 47 which is rotatably connected to a rotary shaft 46 of said motor 43 is disposed in said water circulating cylinder 45.

Said screw member 47 can transport a liquid upwardly, so water is circulated from an opening 48 and contacts said activating stones 7, whereby a circulation of liquid is performed as shown by the arrows through opening 45*a*.

Said activating stone is produced in OKAYAMA-KEN and GIFU-KEN in Japan as a natural stone and is a ceramic stone after the crushing of said natural stone. A radiation level of said Alpha-rays, Beta-rays and Gamma-rays is at a very low level that is less than the natural radiation level which is in a natural state.

In said construction of FIG. 6, 300 cc of water is changed to mineral liquid in two to five minutes, for example, in a car, train and hotel.

Said mineral liquid is pasteurized and many elements are included, whereby said liquid will not go bad for more than several months in the summer under natural conditions.

It is possible to process a Japanese wine thereby and wine processed by said stone of the present invention becomes soft in taste by our experiment. Further it is possible to process gasoline and oil by said stone of the present invention whereby it becomes an activated gasoline and oil. Further it is possible to process liquid paint and liquid cement, whereby they become an activated liquid paint and a liquid cement for eliminating mildew.

In the embodiment of FIG. 6, a liquid is circulated from the lower position to an upper position by said screw member, but the device is also able to operate vice versa.

I claim:

1. A mineral liquid producing device comprising a housing member for housing an activating stone and a liquid circulating means for circulating a liquid in said housing member by recirculating said liquid over said activating stone a plurality of times, whereby said liquid is changed to a mineral liquid by circulating and contacting said liquid with said activating stone.

2. A mineral liquid producing device as claimed in claim 1, wherein said activating stone radiates Alpha-rays, Beta-rays, and Gamma-rays.

3. A mineral liquid producing device as claimed in claim 1, wherein said activating stone comprises tantalum oxide, yttrium oxide and radium oxide.

4. A mineral liquid producing device as claimed in claim 1, wherein said activating stone is housed in a liquid circulating cylinder and said cylinder is mounted to a cover member of a vessel, a rotary screw is rotatably housed in said cylinder, and a motor is mounted on said cover member for rotating said screw.

5. A mineral liquid producing device comprising:

a housing for housing an activating stone, the housing having a first opening at a first end and a second opening at a second end thereof;

a screw member in said housing for pulling a liquid through said housing;

a motor for rotating said screw; and a vessel surrounding said housing, said motor being mounted on said vessel;

wherein rotation of said screw member pulls said liquid from said second end of said housing to said first end, said liquid then circulating through said first opening, through said vessel, and through said second opening.

* * * * *